US009627806B2

(12) United States Patent
Wu et al.

(10) Patent No.: US 9,627,806 B2
(45) Date of Patent: Apr. 18, 2017

(54) INSULATIVE HOUSING OF A CABLE CONNECTOR ASSEMBLY HAVING A ONE PIECE STRUCTURE LATCH

(71) Applicant: FOXCONN INTERCONNECT TECHNOLOGY LIMITED, Grand Cayman (KY)

(72) Inventors: Jerry Wu, Irvine, CA (US); Jun Chen, Kunshan (CN); Xiao Fan, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 14/870,012

(22) Filed: Sep. 30, 2015

(65) Prior Publication Data

US 2016/0093976 A1 Mar. 31, 2016

(30) Foreign Application Priority Data

Sep. 30, 2014 (CN) ..... 2014 1 0514356

(51) Int. Cl.
*H01R 13/627* (2006.01)
*H01R 13/436* (2006.01)
*H01R 13/506* (2006.01)

(52) U.S. Cl.
CPC ..... *H01R 13/6271* (2013.01); *H01R 13/4367* (2013.01); *H01R 13/506* (2013.01)

(58) Field of Classification Search
CPC ..... H01R 13/6271; H01R 13/6272; H01R 13/6273; H01R 13/4367; H01R 13/506
USPC ..... 439/660, 495, 499, 465, 298, 596, 686, 439/689, 707, 701, 711–713, 746, 747
See application file for complete search history.

(56) References Cited

U.S. PATENT DOCUMENTS 6,257,914 B1 * 7/2001 Comerci ..... H01R 13/6273 439/357
6,951,476 B1 * 10/2005 Saito ..... H01R 13/582 439/495
7,357,664 B2 * 4/2008 Hsu ..... H01R 43/0221 439/499
7,390,220 B1 * 6/2008 Wu ..... H01R 9/03 439/607.06
7,452,238 B1 * 11/2008 Wu ..... H01R 12/592 439/579

(Continued)

FOREIGN PATENT DOCUMENTS

CN 202930591 U 5/2013

*Primary Examiner* — Abdullah Riyami
*Assistant Examiner* — Harshad Patel
(74) *Attorney, Agent, or Firm* — Wei Te Chung; Ming Chieh Chang

(57) ABSTRACT

A cable connector assembly includes an insulative housing, a spacer mounted at a rear of the insulative housing, and an outer boot enclosing the spacer and a part of the insulative housing. The insulative housing includes a top wall, a bottom wall, and a pair of side walls connecting the top wall and the bottom wall. The insulative housing includes a pair of latches extending rearwardly from the side walls respectively. Each of the latches has a one piece flat structure and comprises a lock part projecting outwardly from a free end thereof, and the spacer defines a pair of holes corresponding to the latches, the latches passing through the holes to fix the spacer on the insulative housing.

2 Claims, 7 Drawing Sheets

(56) References Cited

U.S. PATENT DOCUMENTS

| | | | | |
|---|---|---|---|---|
| 7,632,155 | B1 * | 12/2009 | Wu | H01R 9/035 439/497 |
| 8,133,071 | B2 * | 3/2012 | Huang | H01R 12/778 439/499 |
| 9,172,149 | B2 * | 10/2015 | Xing | H01R 9/035 |
| 2005/0124210 | A1 * | 6/2005 | Zhang | H01R 13/506 439/495 |

* cited by examiner

INSULATIVE HOUSING OF A CABLE CONNECTOR ASSEMBLY HAVING A ONE PIECE STRUCTURE LATCH

BACKGROUND OF THE INVENTION

1. Field of the Invention

The present invention relates to a cable connector assembly, especially to a structure of an insulative housing latch thereof.

2. Description of Related Arts

Internal USB 3.0 connectors are widely used. Generally, the internal USB 3.0 connector comprises an insulative housing, a plurality of contacts received in the insulative housing, and a spacer to arrange the contacts. The spacer defines a pair of latching hole portions, and the insulative housing comprises a pair of latch portions latched with the latching hole portions, respectively. Each of the latching hole portions comprises a pair of through holes. Each of the latch portions comprises a pair of latch beams to be inserted into the through holes, respectively. The latch beams do not provide enough retaining force because of limited dimension and is apt to breakage under multi-directional force. China Patent No. 202930591, issued on May 8, 2013, discloses a cable connector assembly including an insulative housing and a spacer mounted at a rear of the insulative housing. The insulative housing has two latches at two sides thereof. Each of the latches has an interior notch. The spacer has two corresponding tubers. When the spacer is mounted on the insulative housing, the protrusion is stuck in the notch. A disadvantage of such design is that the tuber will be reduced under friction after repeated use. Therefore, the spacer may disengage from the insulative housing easily.

An improved structure of the latch is desired.

SUMMARY OF THE INVENTION

An object of the present invention is to provide a cable connector assembly including an improved latch of the insulative housing.

To achieve the above-mentioned object, a cable connector assembly comprises: an insulative housing comprising a top wall, a bottom wall, and a pair of side walls connecting the top wall and the bottom wall; a spacer mounted at a rear of the insulative housing; and an outer boot enclosing the spacer and a part of the insulative housing; wherein the insulative housing comprises a pair of latches extending rearwardly from the side walls respectively, each of the latches having a one piece flat structure and comprising a lock part projecting outwardly from a free end thereof, and the spacer defines a pair of holes corresponding to the latches, the latches passing through the holes to fix the spacer on the insulative housing.

Other objects, advantages and novel features of the invention will become more apparent from the following detailed description when taken in conjunction with the accompanying drawings.

DETAILED DESCRIPTION OF THE PREFERRED EMBODIMENT

Figure 1:
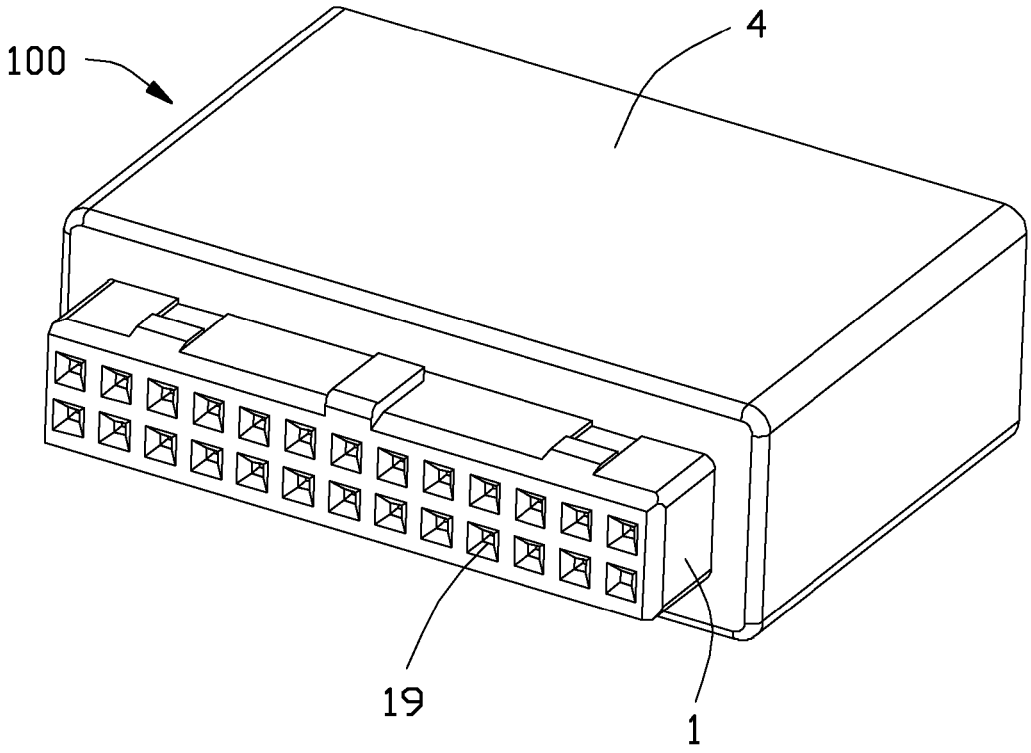
FIG. 1 is a perspective view of a cable connector assembly according to the present invention.
Figure 2:
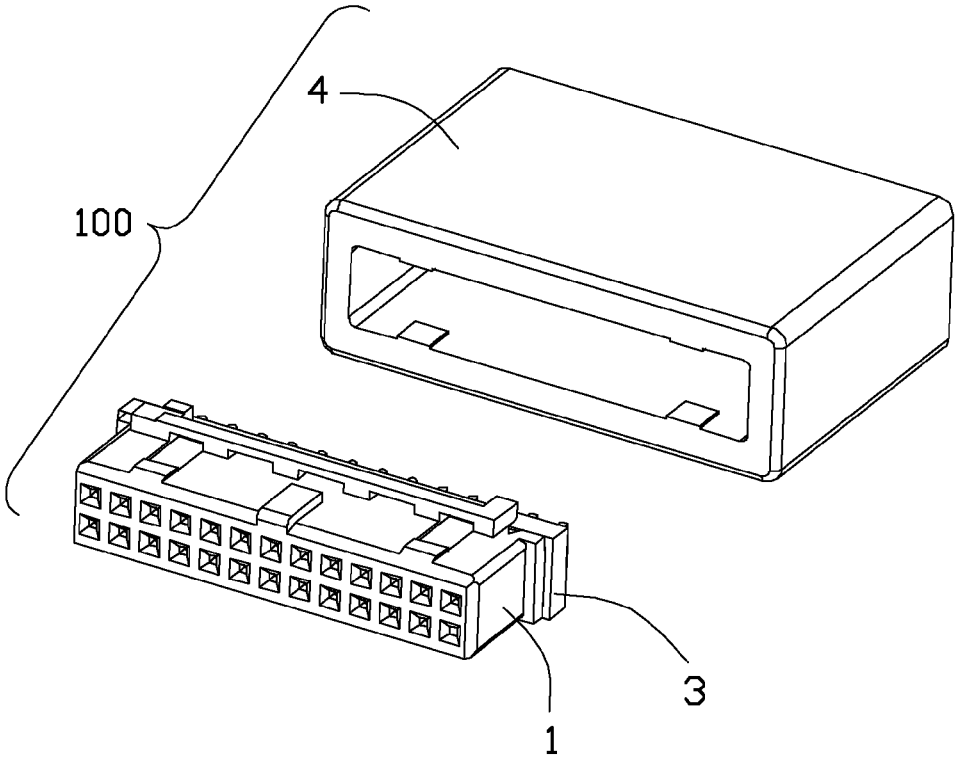
FIG. 2 is an exploded view of the cable connector assembly.
Figure 3:
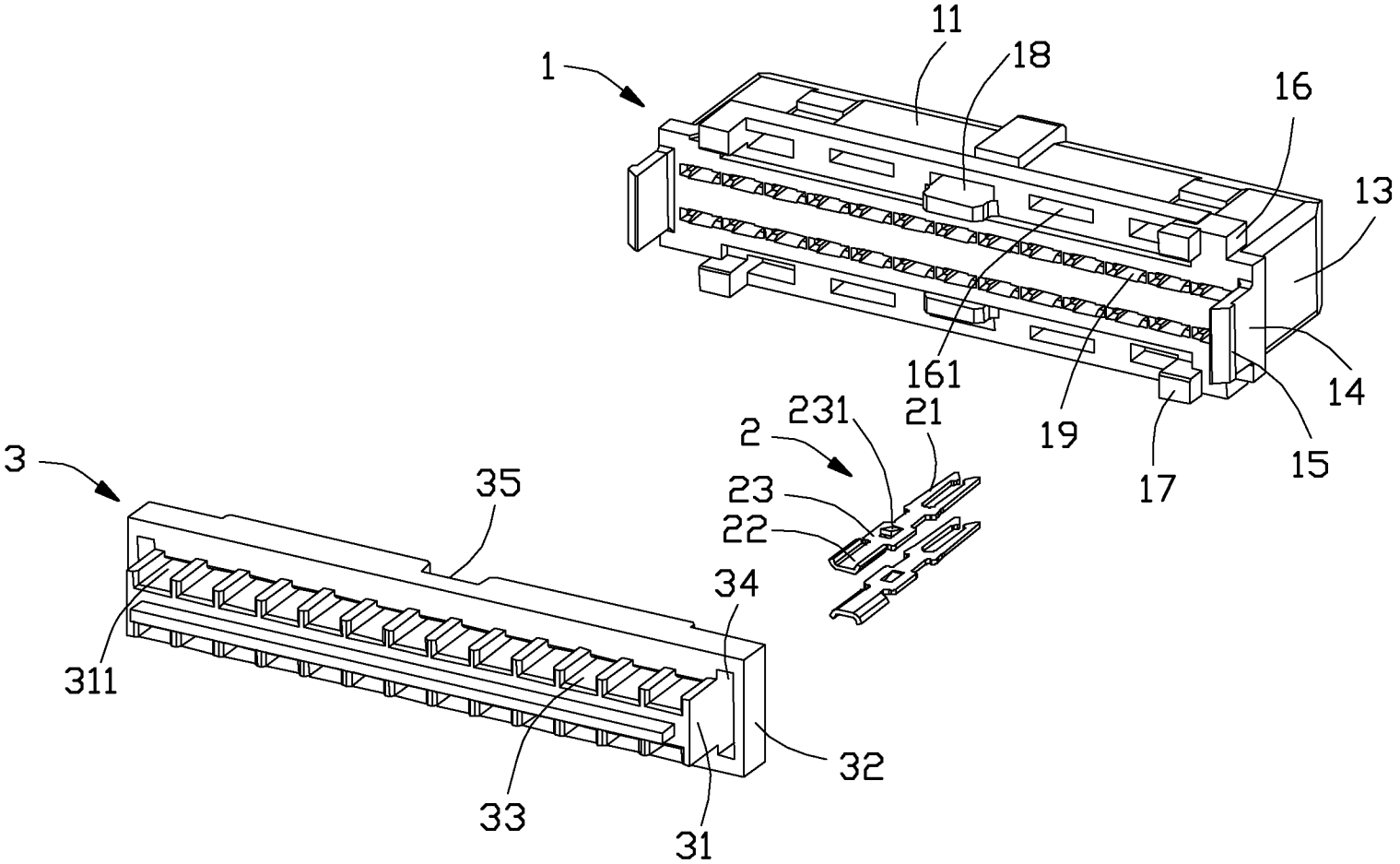
FIG. 3 is an exploded view of the cable connector assembly omitting an outer boot for clarity.

Reference will now be made in detail to the preferred embodiment of the present invention. Referring to FIGS. 1-3, a cable connector assembly 100 includes an insulative housing 1, a number of conductive terminals 2, a spacer 3 mounted on rear of the insulative housing 1, and an outer boot 4 enclosing the spacer 3 and a part of the insulative housing 1.

Figure 4:
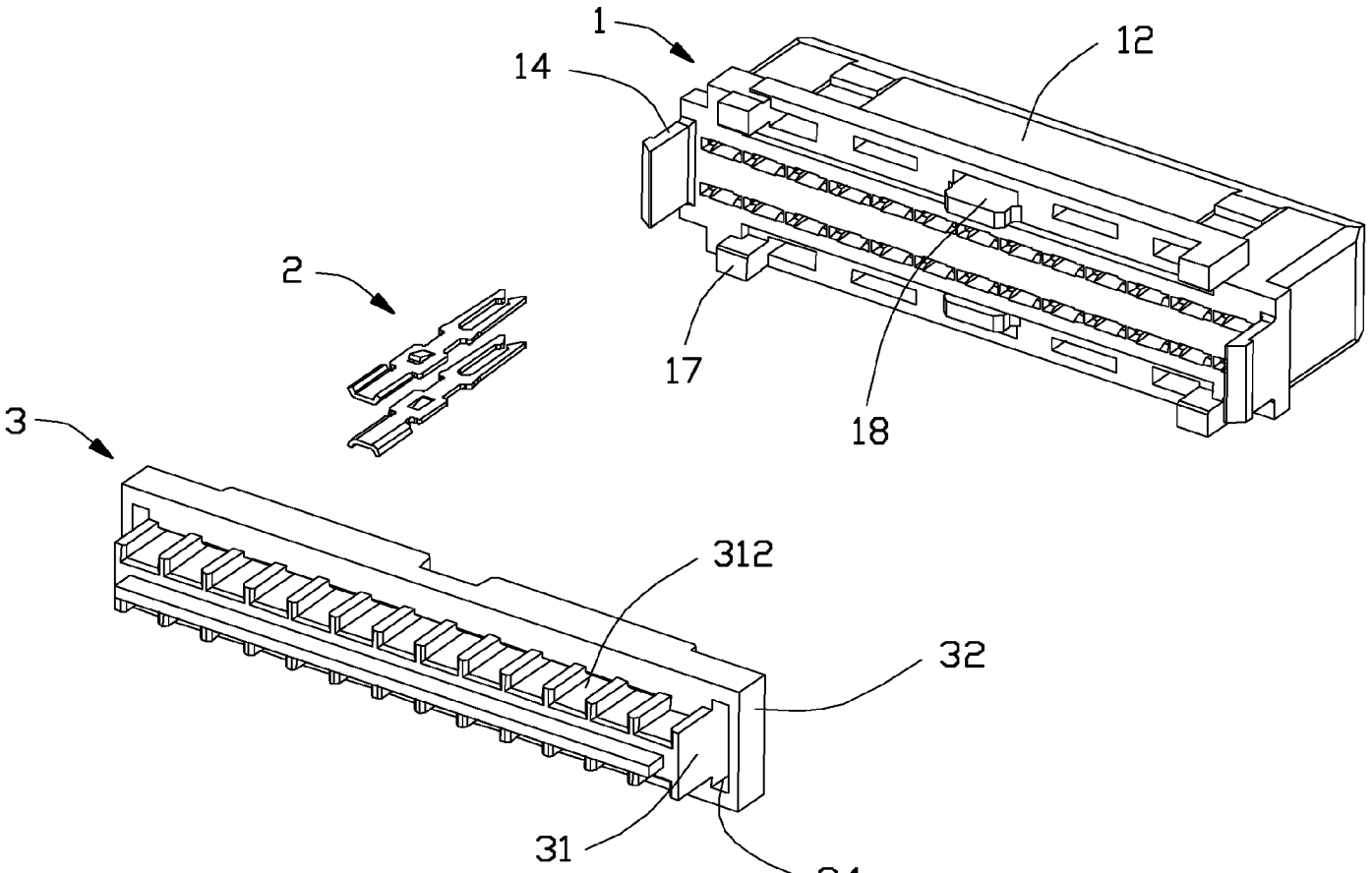
FIG. 4 is a view similar to FIG. 3 but from another perspective.
Figure 5:
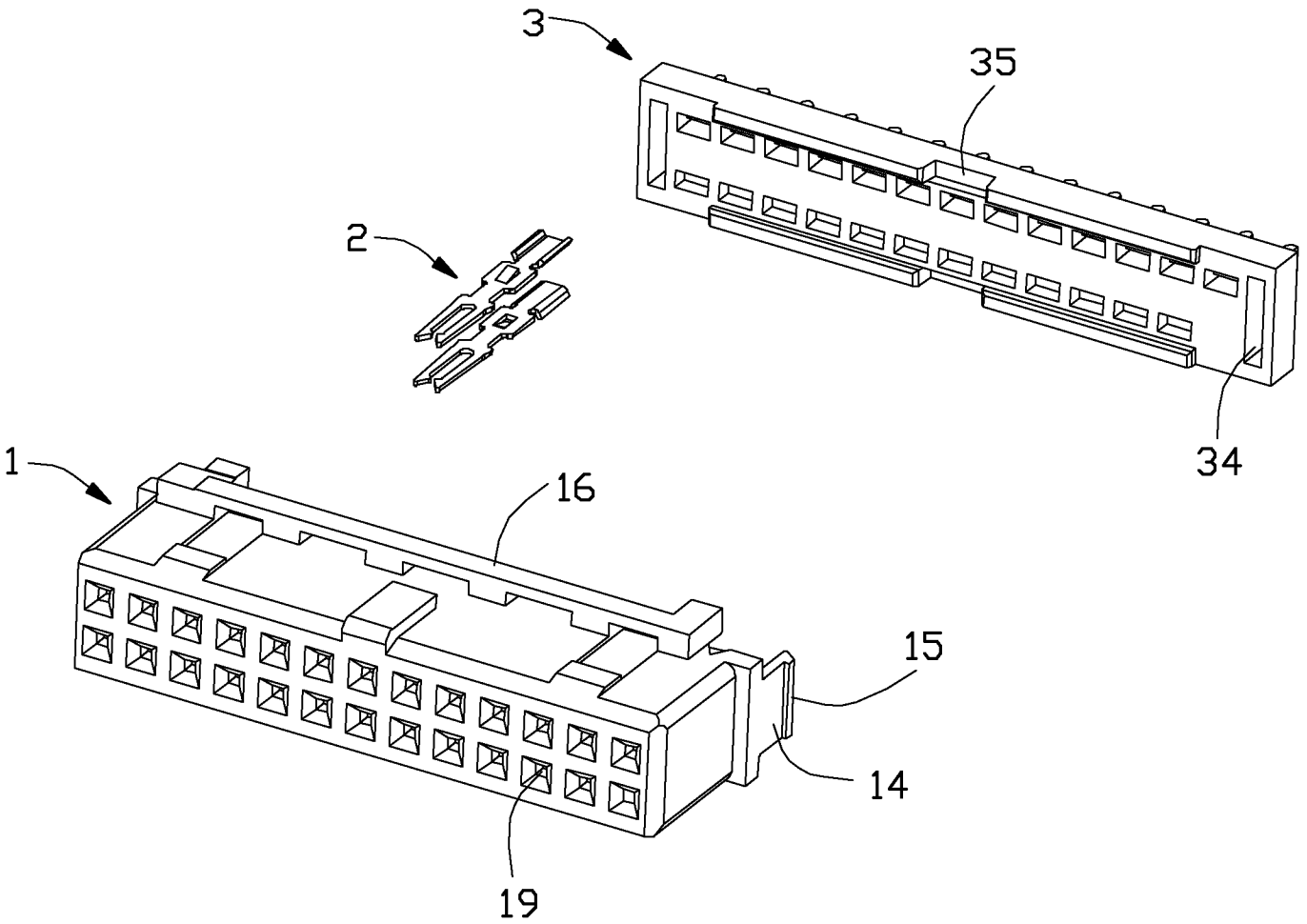
FIG. 5 is a view similar to FIG. 3 but from still another perspective.

Referring to FIGS. 3-5, the insulative housing 1 includes a top wall 11, a bottom wall 12 opposite to the top wall 11 in a vertical direction (not labeled), and a pair of side walls 13 connecting the top wall 11 and the bottom wall 12 and opposite to each other in a longitudinal direction X (FIG. 6) perpendicular to the vertical direction. The side walls extend to the spacer 3 and form two latches 14. The latch 14 is a one-piece structure to increase strength of the latch. End of the latch 14 extends outwardly and forms a lock part 15 at an end thereof. The lock part 15 has a slant face for the latch 14 to conveniently mate with the spacer 3. Each of the side walls 13 of the insulative housing 1 has a latch 14. The insulative housing 1 has two extending portions 16 respectively on the top wall 11 and the bottom wall 12. The extending portion 16 has a plurality of openings 161 running through the extending portion 16, molten plastics during molding the outer boot 4 is formed in the openings 161 for strengthening retention of the outer boot 4 to the insulative housing 1. The number of openings 161 can be one or more. The extending portion 16 on each of the top wall 11 and the bottom wall 12 has a pair of posts 17 extending backwardly. The pair of posts 17 on the top wall 11 are symmetrical to the pair of posts 17 on the bottom wall 12. The pair of post 17 on the top wall 11 and the pair of post 17 on the bottom wall 12 cooperate to clamp the spacer 3. The extending portion 16 further has a tab 18 extending backwardly. The insulative housing 1 defines a number of terminal receiving passageways 19 running through a front face and a rear face of the insulative housing 1. The terminal receiving passageways 19 are arranged in two rows.

The conductive terminal 2 includes a mating portion 21 received in the terminal receiving passageway 19, a tail 22 extending beyond the insulative housing 1, and a holding portion 23 connecting the mating portion 21 and the tail 22. The holding portion 23 has a shrapnel 231 interference fitting with the spacer 3 for fixing the conductive terminals 2.

Figure 6:
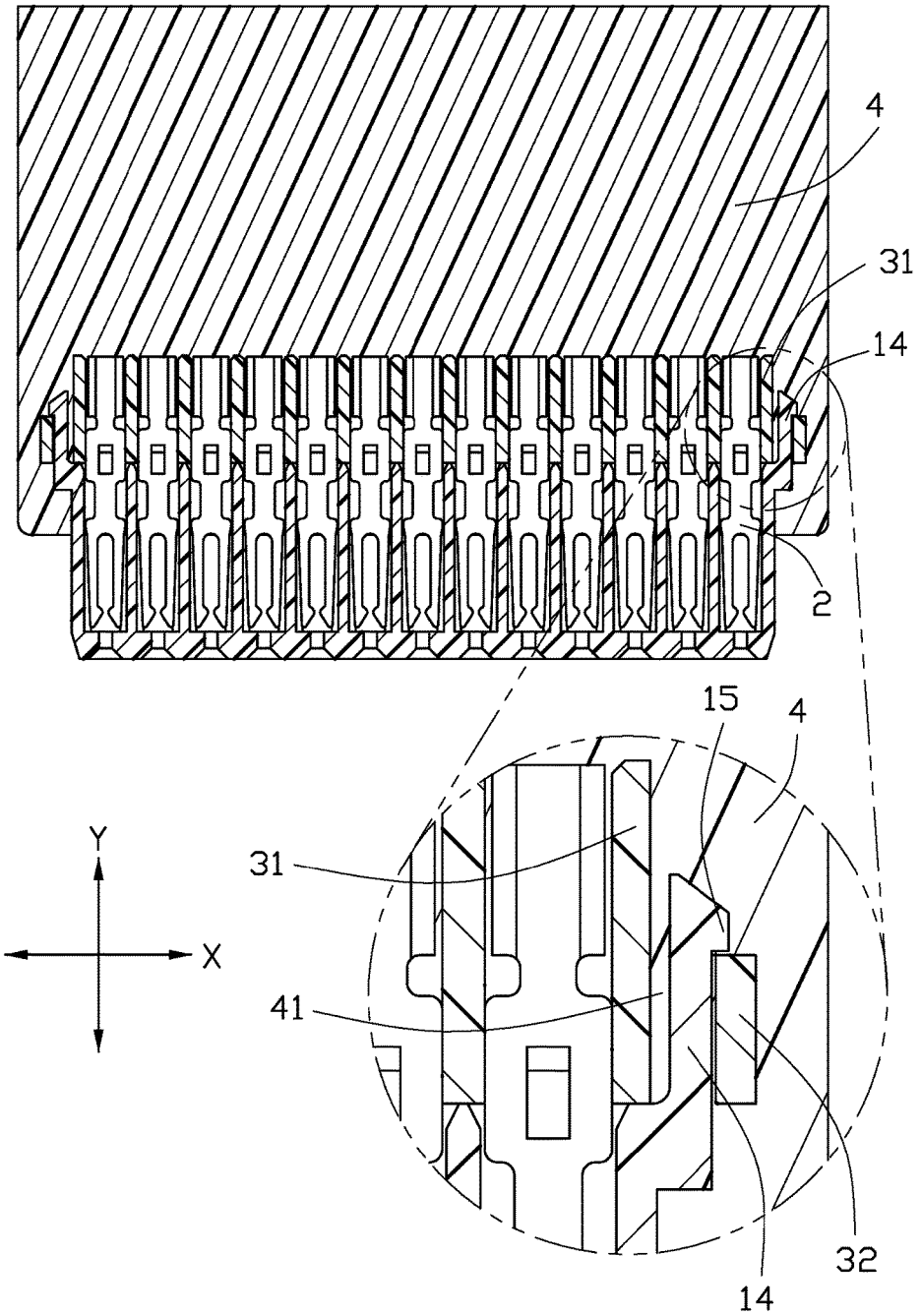
FIG. 6 is a cross-sectional view of the cable connector assembly to show the latch in the hole and secured by the boot.
Figure 6A:
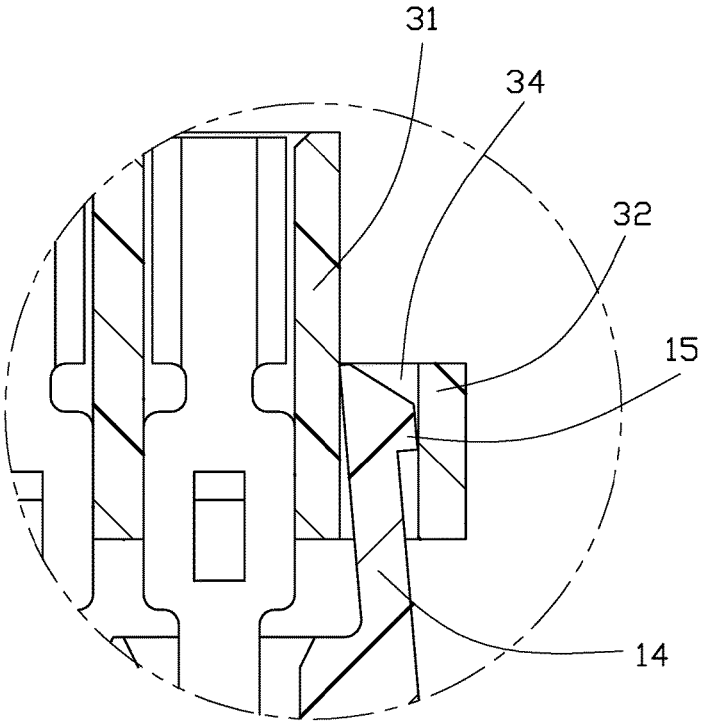
FIG. 6(A) is an enlarged portion of a cross-sectional view of the cable connector assembly to show the latch is passing through the hole of the spacer in a deflected manner during assembling.

The spacer 3 is made of insulating materials. The spacer 3 includes a main portion 31 and a mounting portion 32 connecting with the main portion 31. The main portion 31 includes an upper face 311, a lower face 312, and a number of limiting grooves 33 on the upper face 311 and on the lower face 312. The conductive terminals 2 are spaced apart from each other by the limiting grooves 33. The mounting portion 32 of the spacer 3 defines a hole 34 corresponding to the latch 14. The lock part 15 of the latch 14 enhances the interference fit of the spacer 3 and the insulative housing 1. The mounting portion 32 of the spacer 3 has two notches 35. The tabs 18 of the extending portions 16 are received in corresponding notches 35. As shown in FIGS. 6 and 6(A), the hole (34) is dimensioned to allow the lock part 15 of the latch 14 to be inwardly deflected during passing through the corresponding hole 34 when assembling while resuming back to its original straight position to be engaged with the spacer 3 along the font-to-back direction Y perpendicular to both the vertical direction and the longitudinal direction X after the spacer 3 is fully assembled to the housing 1 along the front-to-back direction Y. Notably, the latch 14 occupies a portion of the corresponding hole 34 while a portion 41 of the outer boot 4 occupies/fills remaining portions of the corresponding hole 34 after the outer boot 4 is molded upon the housing 1, and the portion 41 abuts against the latch 14 to prevent backward and inward deflection of the corresponding latch in the longitudinal direction X so as to assure locking between the spacer and the locking part of the housing in the front-to-back direction Y perpendicular to both the vertical direction and the longitudinal direction Y.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the members in which the appended claims are expressed.

What is claimed is:

1. A cable connector assembly comprising:

an insulative housing comprising a top wall, a bottom wall, and a pair of side walls connecting the top wall and the bottom wall;

a spacer mounted at a rear of the insulative housing; and a plurality of conductive terminals each having a mating portion received in the insulative housing, a holding portion fixed to the spacer, and a tail for connecting to a cable; and an outer boot enclosing the spacer and a part of the insulative housing; wherein the insulative housing comprises a pair of latches extending rearwardly from the side walls respectively, each of the latches having a one piece flat structure and comprising a lock part projecting outwardly from a free end thereof, the spacer defines a pair of holes corresponding to the latches, the latches passing through the holes to fix the spacer on the insulative housing, the insulative housing has an extending portion defining a plurality of openings therethrough, the extending portion is provided on each of the top wall and the bottom wall of the insulative housing, each of the extending portions has a pair of posts extending backwardly to clamp the spacer, the spacer has a notch, and the extending portion has a tab received in the notch.

2. The cable connector assembly as claimed in claim 1, wherein the lock part defines a slant face for guiding the latch into the hole.

* * * * *